US008335338B2

(12) United States Patent
Sano et al.

(10) Patent No.: US 8,335,338 B2
(45) Date of Patent: Dec. 18, 2012

(54) SPEAKER AND ELECTRONIC APPARATUS AND DEVICE USING THE SAME

(75) Inventors: Kouzi Sano, Mie (JP); Masahide Sumiyama, Mie (JP); Takanori Fukuyama, Mie (JP); Takeshi Shimokawatoko, Mie (JP); Kazutaka Kubo, Mie (JP); Satoshi Itoh, Mie (JP); Kazuki Honda, Mie (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/352,631

(22) Filed: Jan. 18, 2012

(65) Prior Publication Data

US 2012/0114166 A1 May 10, 2012

Related U.S. Application Data

(62) Division of application No. 12/160,227, filed as application No. PCT/JP2007/050758 on Jan. 19, 2007.

(30) Foreign Application Priority Data

Jan. 24, 2006 (JP) ..... 2006-014860

(51) Int. Cl.
*H04R 1/00* (2006.01)

(52) U.S. Cl. ..... 381/412; 381/182; 381/184; 381/353; 381/360; 381/361; 381/371; 381/374; 381/386; 381/398; 381/413; 381/417; 381/420; 381/423; 381/431

(58) Field of Classification Search ..... None
See application file for complete search history.

(56) References Cited

U.S. PATENT DOCUMENTS

| | | | | |
|---|---|---|---|---|
| 4,337,379 | A | 6/1982 | Nakaya | |
| 6,584,209 | B1 | 6/2003 | Wang | |
| 2002/0057821 | A1 | 5/2002 | Tsumori et al. | |
| 2004/0156527 | A1 | 8/2004 | Stiles et al. | |
| 2004/0218779 | A1 * | 11/2004 | Fukuyama et al. | 381/409 |
| 2006/0050922 | A1 | 3/2006 | Tomoeda et al. | |

FOREIGN PATENT DOCUMENTS

| | | | |
|---|---|---|---|
| CN | 2 277 153 | Y | 3/1998 |
| CN | 1 698 396 | A | 11/2005 |
| CN | 1 703 115 | A | 11/2005 |
| EP | 1 589 782 | A1 | 10/2005 |
| JP | 53-129023 | A | 11/1978 |

(Continued)

OTHER PUBLICATIONS

European Search Report for PCT/JP2007-050758 dated Feb. 26, 2009. International Search Report for PCT/JP2007-050758 dated May 1, 2007.

*Primary Examiner* — Julio J Maldonado
*Assistant Examiner* — Yasser Abdelaziez
(74) *Attorney, Agent, or Firm* — Pearne & Gordon LLP

(57) ABSTRACT

The present invention relates to a loudspeaker in the acoustic field and the information communication field. The invention provides a loudspeaker that can realize a thinner size. To achieve this, the loudspeaker of the present invention is structured so that a part of a diaphragm is inserted to a dent or an opening formed at the center poles of a lower plate of a magnetic circuit. This structure allows the diaphragm to be stored within the height of the magnetic circuit, thus allowing the loudspeaker to have a thinner size.

28 Claims, 5 Drawing Sheets

FOREIGN PATENT DOCUMENTS

| | | | |
|---|---|---|---|
| JP | 59-012691 | A | 1/1984 |
| JP | 08-102993 | A | 4/1996 |
| JP | 09-238396 | A | 9/1997 |
| JP | 2002-281593 | A | 9/2002 |
| JP | 2003-037892 | A | 2/2003 |
| JP | 2003-134585 | A | 5/2003 |
| JP | 2004-266337 | A | 9/2004 |
| JP | 2004-297318 | * | 10/2004 |
| JP | 2004-297318 | A | 10/2004 |
| JP | 2005-051283 | A | 2/2005 |

* cited by examiner

SPEAKER AND ELECTRONIC APPARATUS AND DEVICE USING THE SAME

This application is a division of U.S. patent application Ser. No. 12/160,227 filed Jul. 8, 2008 which is incorporated herein by reference in its entirety.

TECHNICAL FIELD

The present invention relates to a speaker (hereinafter referred to as loudspeaker) used for various acoustic devices and information communication devices and an electronic device and an apparatus using the loudspeaker.

BACKGROUND ART

A conventional loudspeaker will be described with reference to FIG. 16. FIG. 16 is a cross-sectional view illustrating a conventional loudspeaker.

As shown in FIG. 16, magnetized magnet 1 is coupled to lower plate 3 having center pole 3A and a side of magnet 1 opposite to the side coupled to lower plate 3 is coupled to upper plate 2 to constitute external magnetization-type magnetic circuit 4. Magnetic circuit 4 is coupled to frame 6. A periphery of frame 6 is coupled to diaphragm 7. Diaphragm 7 is coupled to voice coil 8. Voice coil 8 is inserted to magnetic gap 5 of magnetic circuit 4, thereby constituting a loudspeaker.

This conventional loudspeaker has an overall height structure using a so-called buildup method in which magnetic circuit 4 is coupled to frame 6. Due to this structure, the conventional loudspeaker has required, at minimum, an overall height obtained by adding a size of magnetic circuit 4 to a size of frame 6.

Recently, flat-screen televisions (e.g., liquid crystal televisions, plasma televisions) are more prevalent in the field of AV products, resulting in the recent rapid increase in requirements for a smaller overall height of a loudspeaker. The mobile product field also shows requirements for a mobile phone having multiple functions and a thinner size, showing very strong requirements for a thinner loudspeaker. On the other hand, the in-vehicle application field also shows very strong requirements for a smaller, thinner, and more lightweight loudspeaker involved with energy conservation to protect the global environment.

Due to these backgrounds, more conventional loudspeakers as described above have been developed to satisfy such requirements for a smaller, thinner, and more lightweight loudspeaker.

Because of the circumstance as described above, there is already a limitation on realizing both of the structure of the conventional loudspeaker and a thinner size while satisfying the market demands. Thus, a new revolutionary structure is required for a loudspeaker, resulting in particular in the recent enhanced development for realizing a loudspeaker having a thinner size. Information for publications for the related art regarding this application includes Patent Publication 1 for example.

As described above, the conventional loudspeaker is disadvantageous in that there is already a limitation on realizing both of the conventional loudspeaker structure and a thinner size while satisfying the strict market demands. Furthermore, there are other demands from the market for a loudspeaker to have an improved conversion efficiency for the purpose of energy conservation and a further improved sound pressure level.

In order to cope with these requirements, only options are to use a magnet having a large volume or to add a cancel magnet to constitute a repulsive magnetic circuit to efficiently use the magnetic energy of the magnet.

Any of the options cannot avoid an increased volume of a magnetic circuit including a magnet, showing a further difficulty in realizing a thinner size.

[Patent Publication 1] Japanese Patent Unexamined Publication No. 2005-51283

SUMMARY OF THE INVENTION

The present invention solves the disadvantage as described above. The invention provides a superior loudspeaker that can realize a thinner size. In order to solve the above disadvantage, the present invention has the following structure.

Specifically, the present invention provides a loud speaker including: a magnetic circuit that includes a lower plate having center pole where a dent or an opening is provided at its center, a magnet coupled to the lower plate, and an upper plate coupled to a side of the magnet opposite to the lower plate; a frame coupled to the magnetic circuit; a diaphragm coupled to the frame; and a voice coil that is coupled to the diaphragm and that is partially provided at a magnetic gap of the magnetic circuit. The diaphragm is structured so that an inner circumference side protrudes to the magnetic circuit than a part coupled to the voice coil and the diaphragm is inserted to the dent or the opening at the center of the center pole.

By inserting a part of the diaphragm to the dent or the opening formed at the lower plate of the magnetic circuit to constitute the loudspeaker, a part of the diaphragm is stored within the height of the magnetic circuit to constitute the loudspeaker. This configuration allows the loudspeaker to have a thinner size, providing a very high industrial value.

REFERENCE MARKS IN THE DRAWINGS

Figure 1:
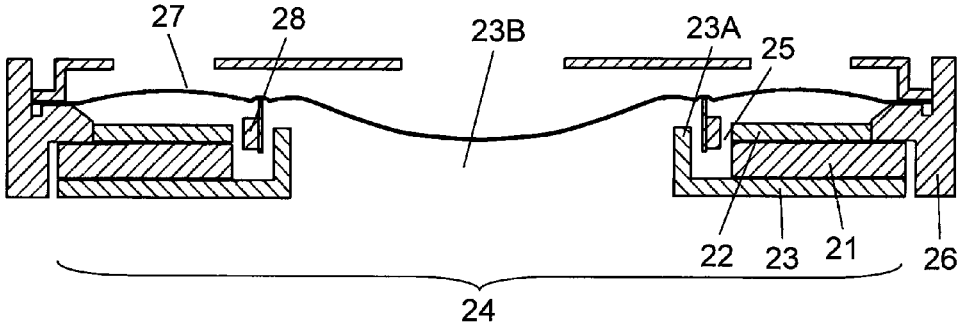
FIG. 1 is a cross-sectional view illustrating a loudspeaker in Embodiment 1 of the present invention.

21 Magnet
22 Upper plate
23 Lower plate
23A Center pole
23B Opening
23C Protector
24 Magnetic circuit
25 Magnetic gap
27 Diaphragm
28 Voice coil
29 Damper
30 First sub magnet
31 Second sub magnet
32 Shield cover
33 and 33A Net
40 Loudspeaker
41 Enclosure
42 Amplifier
43 Player
50 Automobile

DETAILED DESCRIPTION OF PREFERRED EMBODIMENTS

Hereinafter, embodiments of the present invention will be described with reference to the drawings. In the drawings, the same members are denoted with the same reference numerals and will not be described further.

(Embodiment 1)

FIG. 1 is a cross-sectional view illustrating a loudspeaker in Embodiment 1 of the present invention.

As shown in FIG. 1, magnetic circuit 24 is structured so that lower plate 23 having opening 23B at the center of magnetic circuit 24 and having center pole 23A is coupled to magnet 21 and a side of magnet 21 opposite to lower plate 23 is coupled to upper plate 22. Magnetic circuit 24 is coupled to frame 26. Frame 26 is coupled to diaphragm 27. Diaphragm 27 is coupled to voice coil 28. Voice coil 28 is inserted to magnetic gap 25 of magnetic circuit 24. In this manner, the loudspeaker is structured.

Diaphragm 27 has an inverted dome-like shape in which the inner circumference-side parts than parts coupled to voice coil 28 have a cross-sectional shape that protrudes to the magnetic circuit 24. Diaphragm 27 is also structured so that the inverted dome-like shape is inserted to opening 23B at the center of the center pole. This structure allows a part of diaphragm 27 to be stored within the height of magnetic circuit 24, thereby providing a thinner size.

Alternatively, the structure in which a part of diaphragm 27 is always inserted to opening 23B at the center of the center pole is not always required. Another configuration also may be used where, when diaphragm 27 is in a neutral state as shown by the dashed-two dotted line in FIG. 2, a part of diaphragm 27 is not inserted to opening 23B and is inserted to opening 23B when diaphragm 27 is vibrated.

Figure 2:
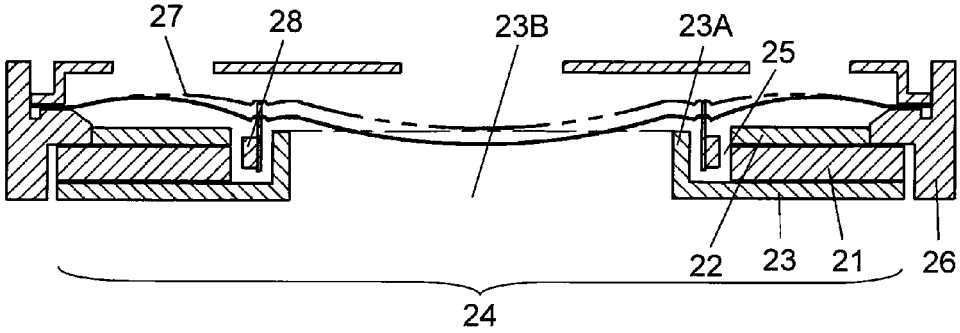
FIG. 2 is a cross-sectional view illustrating another example of a loudspeaker in Embodiment 1 of the present invention.

FIG. 2 is a cross-sectional view illustrating another example of the loudspeaker in Embodiment 1 of the present invention.

In this loudspeaker, diaphragm 27 in the neutral state is shown by the dashed-two dotted line. In this state, diaphragm 27 is not inserted to opening 23B. On the other hand, the state where diaphragm 27 is vibrated (particularly the state where diaphragm 27 is vibrated to the lower side of FIG. 2) is shown by the solid line. In this state, diaphragm 27 is inserted to opening 23B.

This configuration also allows a part of diaphragm 27 in a wide sense (including the state where diaphragm 27 is vibrated) to be stored within the height of magnetic circuit 24, thus realizing a thinner size. This configuration also reduces, even when diaphragm 27 is significantly vibrated, a possibility where diaphragm 27 may have a contact with a part of center pole 23A or other parts for example.

Although the above section has described opening 23B provided at the center of center pole 23A of lower plates 23, the invention is not limited to this embodiment. Opening 23B also may be formed to have a dent-like shape.

Furthermore, diaphragm 27 formed to have the inverted dome-like shape protruding to magnetic circuit 24 can realize a shape rigidity enabled by the depth of the diaphragm and a favorable directional characteristic enabled by the inverted dome-like shape, thereby realizing stable acoustic characteristic and acoustic quality having small distortion.

Figure 3:
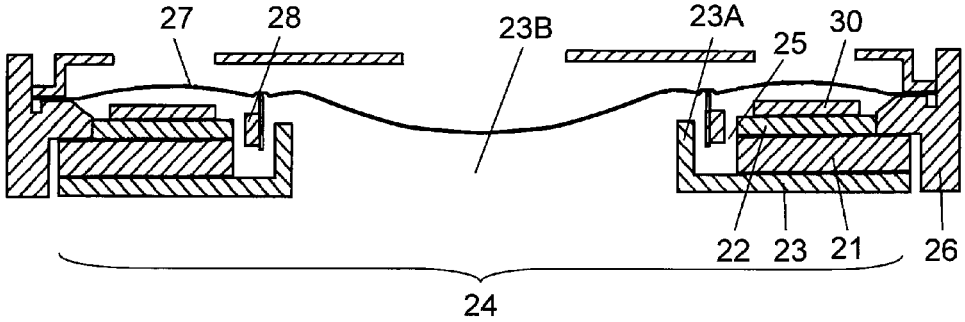
FIG. 3 is a cross-sectional view illustrating the second example of the loudspeaker in Embodiment 1 of the present invention.

FIG. 3 is a cross-sectional view illustrating the second example of the loudspeaker in Embodiment 1 of the present invention.

A configuration as shown in FIG. 3 also may be used where a side of upper plate 22 to a side coupled to magnet 21 further has first sub magnet 30 that is magnetized in a direction opposite to the magnetization direction of magnet 21. This configuration allows first sub magnet 30 to achieve a function of a cancel magnet to improve the main magnetic flux in magnetic gap 25 to reduce the leakage of magnetic flux. This can achieve a further improvement of the sound pressure level of the loudspeaker and the reduction of the leakage of magnetic flux.

Figure 4:
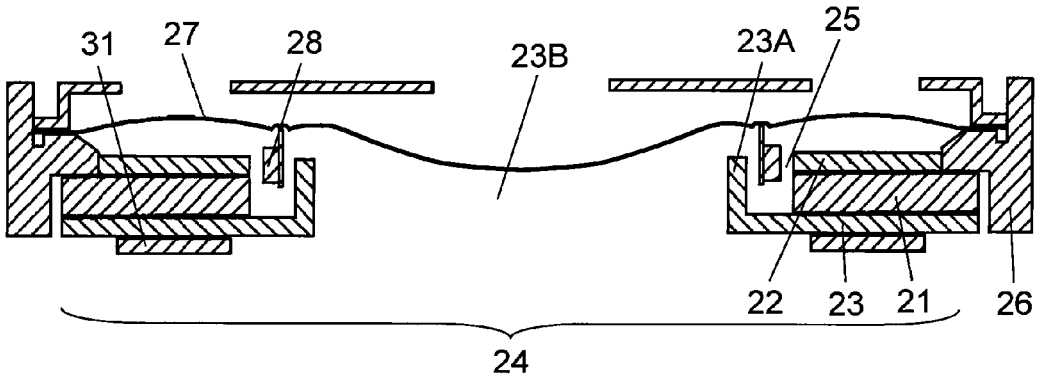
FIG. 4 is a cross-sectional view illustrating the third example of the loudspeaker in Embodiment 1 of the present invention.

FIG. 4 is a cross-sectional view illustrating the third example of the loudspeaker in Embodiment 1 of the present invention.

A configuration as shown in FIG. 4 also may be used where a side of upper plate 22 opposite to a side coupled to magnet 21 has second sub magnet 31 magnetized in a direction opposite to the magnetization direction of magnet 21. This configuration allows second sub magnet 31 to achieve a function of a cancel magnet to improve the main magnetic flux in magnetic gap 25 to reduce the leakage of magnetic flux. This also can achieve a further improvement of the sound pressure level of the loudspeaker and the reduction of the leakage of magnetic flux.

Figure 5:
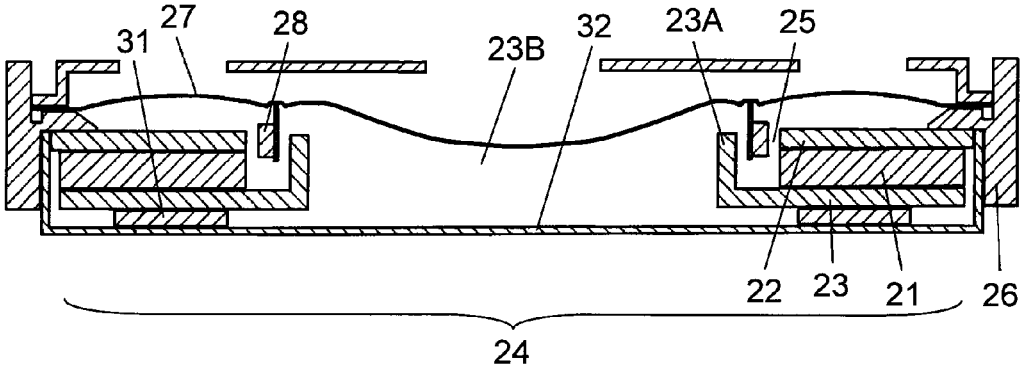
FIG. 5 is a cross-sectional view illustrating the fourth example of the loudspeaker in Embodiment 1 of the present invention.

FIG. 5 is a cross-sectional view illustrating the fourth example of the loudspeaker in Embodiment 1 of the present invention.

A configuration as shown in FIG. 5 also may be used where shield cover 32 is added to the configuration shown in FIG. 4.

Specifically, shield cover 32 is provided to a side of second sub magnet 31 opposite to a side coupled to lower plate 23. This configuration allows the effect by shield cover 32 to further reduce the leakage of magnetic flux. This can achieve a further improvement of the sound pressure level of the loudspeaker and the reduction of the leakage of magnetic flux.

Instead of using a single magnet as described above, a plurality of divided magnets (e.g., two or three magnets) magnetized in opposite directions to one another also can be used to improve the magnetism use efficiency of the entirety of magnetic circuit 24.

Specifically, the volume of one magnet is divided to two or three parts to constitute a magnetic circuit including a sub magnet. The divided magnets can use the same volume as that of a single magnet to provide an improved magnetism use efficiency to the entire magnetic circuit. This can realize a higher sound pressure level through the same volume as that of the single magnet.

Conversely speaking, the magnetic circuit configuration including a sub magnet can achieve the same sound pressure level by reducing the total magnet volume or by reducing the overall height of the magnet. Thus, a thinner size can be achieved.

Figure 6:
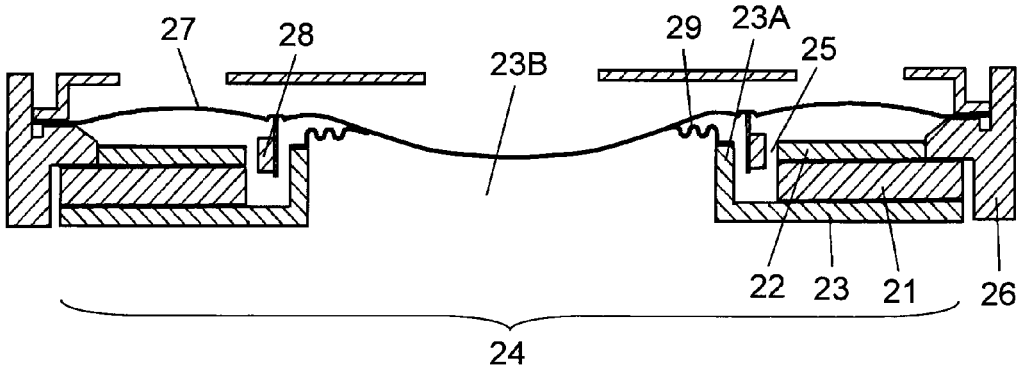
FIG. 6 is a cross-sectional view illustrating the fifth example of the loudspeaker in Embodiment 1 of the present invention.

FIG. 6 is a cross-sectional view illustrating the fifth example of the loudspeaker in Embodiment 1 of the present invention.

A configuration as shown in FIG. 6 also may be used where damper 29 is coupled to an inner circumference than a part of diaphragm 27 coupled to voice coil 28 and frame 26 or a part of magnetic circuit 24.

The addition of damper 29 can further improve the support of diaphragm 27 and voice coil 28 coupled to diaphragm 27. This can reduce gap defects to improve the quality (e.g., to improve the peak power handling) and to improve the reliability.

Figure 7:
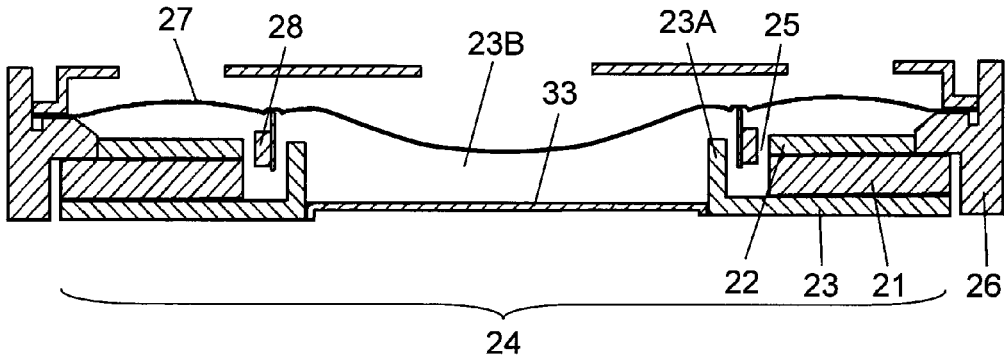
FIG. 7 is a cross-sectional view illustrating the sixth example of the loudspeaker in Embodiment 1 of the present invention.

FIG. 7 is a cross-sectional view illustrating the sixth example of the loudspeaker in Embodiment 1 of the present invention.

A configuration as shown in FIG. 7 also may be used where lower plate 23 has net 33.

Net 33 can be coupled to an inner side face of opening 23B of the center pole of lower plate 23 to achieve the coupling of net 33 without increasing the overall height of the loudspeaker.

Furthermore, net 33 can function as a dust-protective net or a damping net or both of these nets. When net 33 functions as a dust-protective net, net 33 can function to filter-out dirt, dust, or iron powders for example intruded from opening 23B of the center pole of lower plate 23 into magnetic gap 25 for example or water droplets for example, thus reducing defective gaps due to the intrusion of foreign matters.

When net 33 functions as a damping net, an amount of air entering or exiting opening 23B of the center pole of lower plate 23 can be adjusted to adjust an amplitude or the minimum resonant frequency to freely adjust the acoustic characteristic or the acoustic quality.

Figure 8:
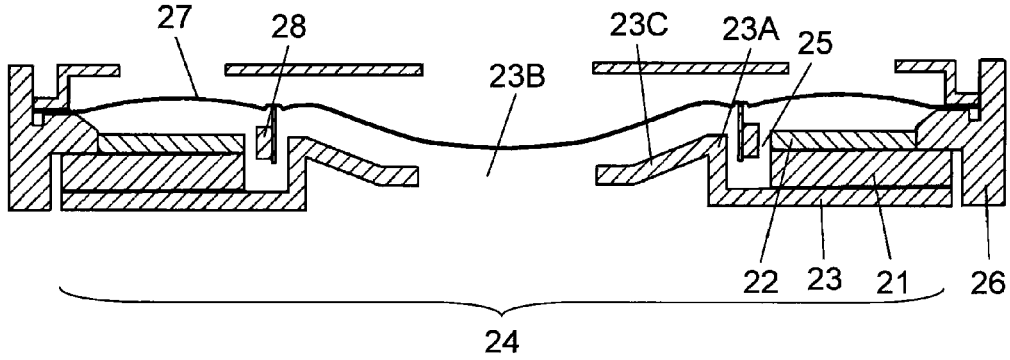
FIG. 8 is a cross-sectional view illustrating the seventh example of the loudspeaker in Embodiment 1 of the present invention.

FIG. 8 is a cross-sectional view illustrating the seventh example of the loudspeaker in Embodiment 1 of the present invention.

A configuration as shown in FIG. 8 also may be used where center pole 23A of lower plate 23 is extended to provide protector 23C of diaphragm 27 to protect the center part of diaphragm 27.

Figure 9:
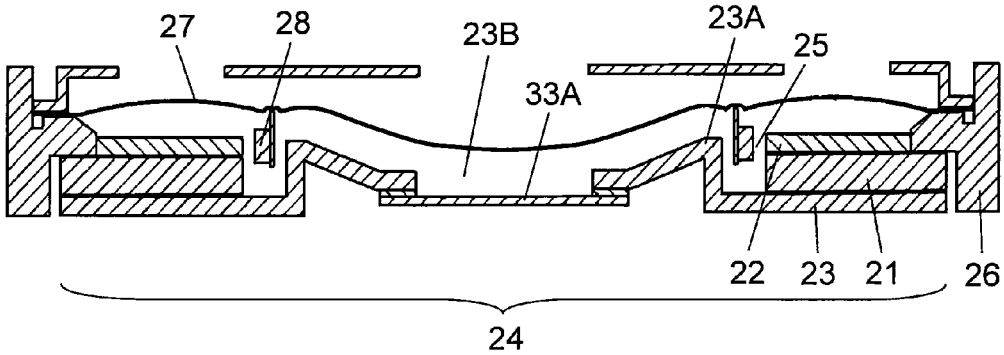
FIG. 9 is a cross-sectional view illustrating the eighth example of the loudspeaker in Embodiment 1 of the present invention.

FIG. 9 is a cross-sectional view illustrating the eighth example of the loudspeaker in Embodiment 1 of the present invention.

A configuration as shown in FIG. 9 also may be used where protector 23C has net 33A to achieve dust protection or damping.

(Embodiment 2)

Next, a loudspeaker in Embodiment 2 of the present invention will be described. The loudspeaker in Embodiment 2 of the present invention has the same cross-sectional view as that of another example shown in FIG. 2 of the loudspeaker in Embodiment 1 of the present invention. Thus, the main structure, the action, and the operation of the loudspeaker in Embodiment 2 of the present invention will be described with reference to FIG. 2.

This loudspeaker includes magnetic circuit 24 that is formed of lower plate 23, magnet 21 coupled to lower plate 23, and upper plate 22 coupled to a side of magnet 21 opposite to lower plate 23.

This loudspeaker further includes frame 26 coupled to magnetic circuit 24, diaphragm 27 coupled to frame 26, and voice coil 28. Voice coil 28 is coupled to diaphragm 27 and is partially placed at straight magnetic gap 25 formed of lower plate 23 and upper plate 22 of magnetic circuit 24.

Lower plate 23 includes a bottom face section and a side wall section arranged in a direction substantially orthogonal to the bottom face section. A plurality of back faces of the side wall sections are opposed to one another so that substantially the center has space 23B. The shape of lower plate 23 is a feature of Embodiment 2 and thus will be described in detail later.

The inner circumference side than a part of diaphragm 27 coupled to voice coil 28 is protruded to magnetic circuit 24 and this protrusion section of diaphragm 27 is not inserted to space 23B at the substantial center of lower plate 23 when diaphragm 27 is in the neutral state (shown by the dashed-two dotted line). This protrusion section of diaphragm 27 is inserted to space 23B at the substantial center of lower plate 23 when diaphragm 27 is vibrated (particularly when diaphragm 27 is vibrated to the lower side of FIG. 2 (shown by the solid line)).

Figure 10:
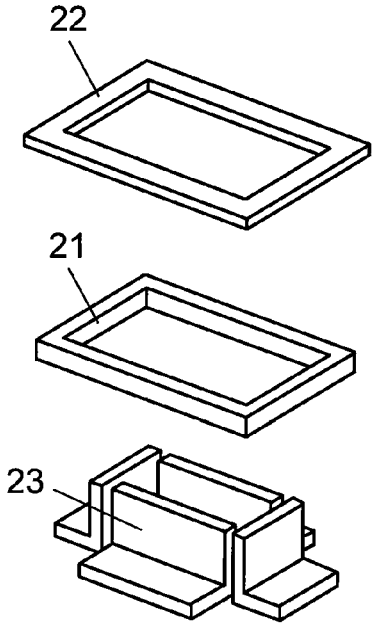
FIG. 10 is an appearance diagram illustrating a lower plate, a magnet, and an upper plate constituting a loudspeaker in Embodiment 2.

FIG. 10 is an appearance diagram illustrating lower plate 23, magnet 21, and upper plate 22 constituting the loudspeaker in Embodiment 2 of the present invention.

As shown in FIG. 10, lower plate 23 is obtained by bending a sheet-like metal. In Embodiment 2, a sheet-like metal is bent so that lower plate 23 includes a bottom face section and a side wall section provided in a direction substantially orthogonal to the bottom face section. The back faces of the four side wall sections of the bent sheet-like metal are opposed to one another so that the substantial center thereof has space 23B.

The four side wall sections of the bent sheet-like metal have thereon magnet 21 so that the four side wall sections are surrounded by magnet 21. Magnet 21 has thereon upper plate 22. In this manner, magnetic circuit 24 is formed. The shape as described above can improve the productivity and the material use efficiency of upper plate 22, magnet 21, and lower plate 23.

Figure 11:
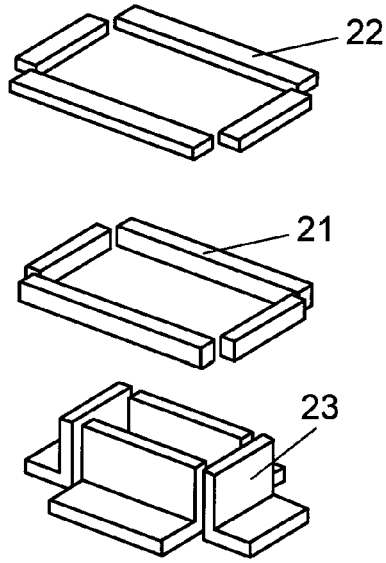
FIG. 11 is an appearance diagram illustrating another example of the lower plate, the magnet, and the upper plate constituting the loudspeaker in Embodiment 2.

FIG. 11 is an appearance diagram illustrating another example of lower plate 23, magnet 21, and upper plate 22 constituting the loudspeaker in Embodiment 2 of the present invention.

As shown in FIG. 11, magnet 21 may be divided to a plurality of parts. Alternatively, magnet 21 also may be divided to the same number as that at which lower plate 23 is divided.

Alternatively, upper plate 22 also may be divided to a plurality of parts as shown in FIG. 11. Alternatively, upper plate 22 also may be divided to the same number of as that at which lower plate 23 is divided.

Alternatively, upper plate 22 also may be divided to the same number of as that at which magnet 21 is divided as shown in FIG. 11.

Although lower plate 23 is divided to the same number at which magnet 21 and upper plate 22 are divided in FIG. 11, the invention is not limited to this embodiment. Only any one or two of lower plate 23, magnet 21, and upper plate 22 also may be divided. For example, only magnet 21, only upper plate 22, or only magnet 21 and upper plate 22 also may be divided. A division number different from these division numbers also may be used. The shape as described above also can improve the productivity and the material use efficiency of upper plate 22, magnet 21, and lower plate 23.

Magnet 21 also may have a bar-like shape. Similarly, upper plate 22 also may have a bar-like shape. Alternatively, both of magnet 21 and upper plate 22 also may have a bar-like shape or any of magnet 21 and upper plate 22 also may have a bar-like shape. The shape as described above can further improve the productivity and the material use efficiency of upper plate 22, magnet 21, and lower plate 23.

Figure 12:
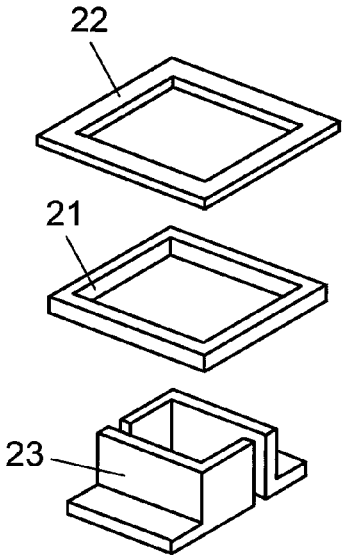
FIG. 12 shows Embodiment 2 of the lower plate, the magnet, and the upper plate constituting the loudspeaker in Embodiment 2.

FIG. 12 is an appearance diagram illustrating lower plate 23, magnet 21, and upper plate 22 constituting the loudspeaker in Embodiment 2 of the present invention in Embodiment 2.

As shown in FIG. 12, lower plate 23 may be divided to two parts and magnet 21 and upper plate 22 also may not be divided. Lower plate 23 also may have a shape as shown in FIG. 12 obtained by bending a sheet-like metal. Side wall sections at the four faces of the two bent metal sheets can have thereon magnet 21 so that the side wall sections are surrounded by magnet 21. Magnet 21 has thereon upper plate 22. In this manner, magnetic circuit 24 can be formed. The shape as described above can further improve the productivity and the material use efficiency of upper plate 22, magnet 21, and lower plate 23.

Figure 13:
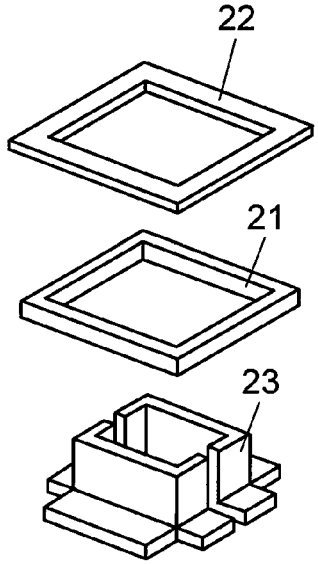
FIG. 13 shows an appearance of the third example of a lower plate, a magnet, and an upper plate constituting the loudspeaker in Embodiment 2.

FIG. 13 is an appearance diagram illustrating the third example of lower plate 23, magnet 21, and upper plate 22 constituting the loudspeaker in the third example of the present invention.

A configuration as shown in FIG. 13 also can be used where lower plate 23 is divided to two parts and magnet 21 and upper plate 22 are not divided for example. Lower plate 23 also can be formed by bending a sheet-like metal to have a shape as shown in FIG. 13. The four side wall sections of the two sheet-like metals have thereon magnet 21 so that the four side wall sections are surrounded by magnet 21. Magnet 21 has thereon upper plate 22. In this manner, magnetic circuit 24 can be formed. The shape as described above can further improve the productivity and the material use efficiency of upper plate 22, magnet 21, and lower plate 23.

The inner circumference-side of diaphragm 27 than the part coupled to voice coil 28 protrudes to magnetic circuit 24 as described above. This protrusion section of diaphragm 27 can have an inverted dome-like shape in cross-section. Alternatively, a net functioning as both a dust-protective net and an acoustic load adjustment net or functioning any of the nets also may be coupled to the inner side face of space 23B at the substantial center of lower plate 23. The effect by diaphragm 27 having the protrusion section having the inverted dome-like shape in cross-section or the effect by the coupling of the net is the same as that by the loudspeaker of Embodiment 1 of the present invention and thus will not be described further.

(Embodiment 3)

Figure 14:
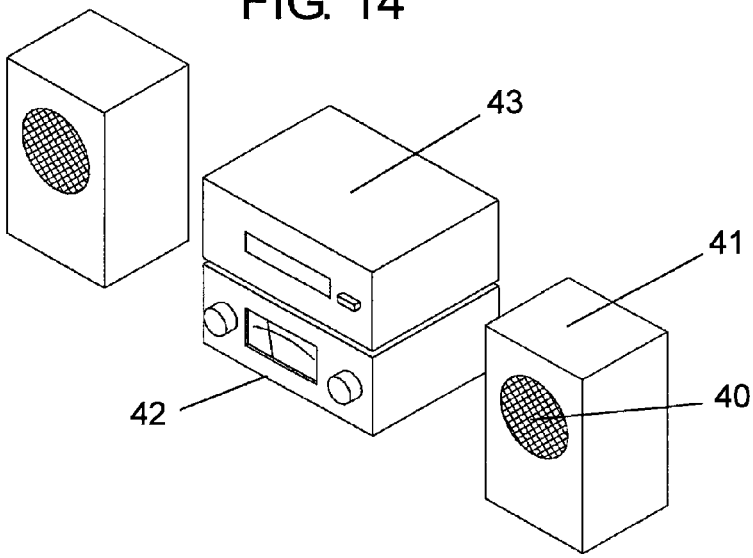
FIG. 14 shows an appearance of an electronic device in Embodiment 3 of the present invention.

FIG. 14 is an appearance diagram illustrating an electronic device in Embodiment 3 of the present invention. In Embodiment 3, the loudspeaker of Embodiment 1 or Embodiment 2 of the present invention and an electronic circuit including an amplifying section of an electric signal inputted to this loudspeaker are provided to constitute an audio mini component system that is also an electronic device.

As shown in FIG. 14, loudspeaker 40 of the present invention is assembled in enclosure 41 to constitute a loudspeaker system. The audio mini component system as an electronic device is composed of amplifier 42 that is an amplifying section of an electric signal inputted to loudspeaker 40 and player 43 that outputs a source inputted to amplifier 42.

By the use of the loudspeaker in which a part of diaphragm 27 is inserted within the height of magnetic circuit 24 of loudspeaker 40 to realize a thinner size, an electronic device such as an audio mini component system can be smaller-sized, thinner-sized, and more lightweight to realize a reduced cost enabled by a proportional reduction of material. Furthermore, an improved sound pressure level and reduced leakage of magnetic flux also can be realized.

Although Embodiment 3 has described an example in which the loudspeaker of the present invention is provided in an audio mini component system as an electronic device, the present invention is not limited to this. The present invention also can be applied to an embodiment where the loudspeaker of the present invention is provided in an electronic device (e.g., a video device such as a television or a mobile communication device such as a mobile phone). Specifically, the present invention can be applied to all electronic devices including a loudspeaker.

(Embodiment 4)

Figure 15:
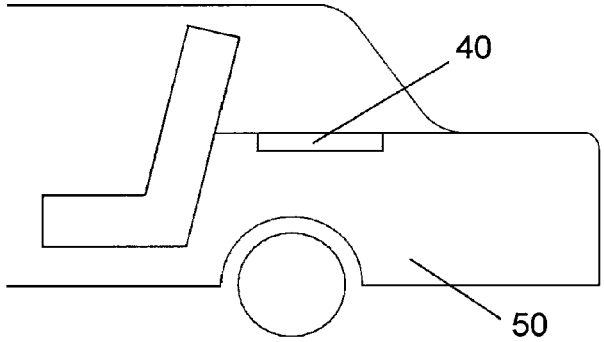
FIG. 15 is a partial cross-sectional view illustrating an apparatus in Embodiment 4 of the present invention.
Figure 16:
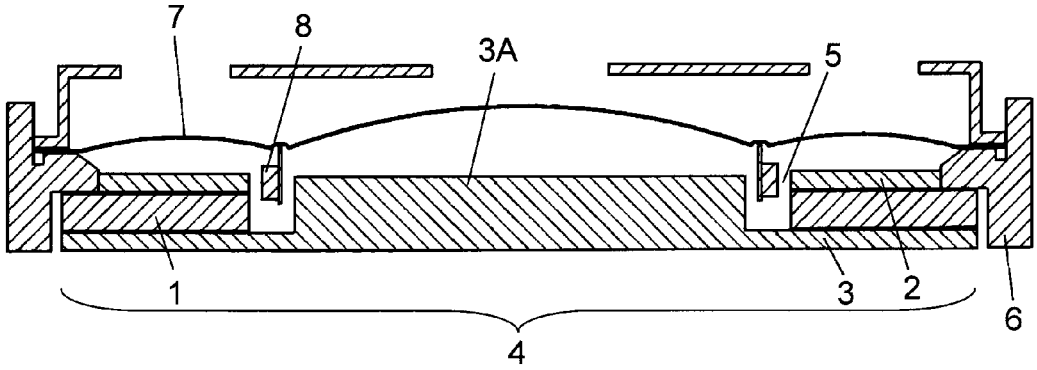
FIG. 16 is a cross-sectional view illustrating a conventional loudspeaker.

FIG. 15 is a cross-sectional view illustrating an automobile that is an apparatus in Embodiment 4 of the present invention.

In Embodiment 4, the loudspeaker of Embodiment 1 or Embodiment 2 of the present invention and a power source (not shown) of this loudspeaker are provided to constitute an automobile as an apparatus. Specifically, loudspeaker 40 is provided in a rear tray of automobile 50 as shown in FIG. 15.

This configuration allows automobile 50 as an apparatus to be more lightweight and more low-cost. This configuration also can realize an improved sound pressure level, reduced leakage of magnetic flux, and energy conservation.

Although Embodiment 4 has described an example in which the loudspeaker is provided in an automobile as an apparatus, the present invention is not limited to this. The apparatus that is Embodiment 4 also may be a transporting apparatus such as a train or a ship or a structure such as a house. Specifically, the present invention can be applied to any apparatus including a loudspeaker.

Industrial Applicability

A loudspeaker, an electronic device, and an apparatus according to the present invention can be applied to an electronic device (e.g., video acoustic device, information communication device, game device) and an apparatus (e.g., automobile) that require to be smaller-sized, thinner-sized, more lightweight, and low-cost and to have an improved sound pressure level and reduced leakage of magnetic flux for example.

The invention claimed is:

1. A loudspeaker comprising:

a magnetic circuit including:

a plurality of lower plates;

a magnet coupled to the plurality of lower plates; and an upper plate coupled to a side of the magnet opposite to the lower plate;

a frame coupled to the magnetic circuit;

a voice coil that is partially provided at a magnetic gap formed of the plurality of lower plates and the upper plate of the magnetic circuit; and a diaphragm coupled to the frame wherein:

the plurality of lower plates include a plurality of bottom face sections and a plurality of side wall sections provided in a direction substantially orthogonal to the bottom face sections, respectively, and a space surrounded by the plurality of side walls section is formed.

2. The loudspeaker according to claim 1, wherein:

the plurality of lower plates are formed by bending a sheet-like metal.

3. The loudspeaker according to claim 1, wherein:

the magnet is divided to a plurality of parts.

4. The loudspeaker according to claim 3, wherein:

a number of the plurality of parts of the magnet is identical to a number of the plurality of lower plates.

5. The loudspeaker according to claim 4, wherein:

the upper plate is divided to a plurality of parts.

6. The loudspeaker according to claim 3, wherein:

the upper plate is divided to a plurality of parts.

7. The loudspeaker according to claim 6, wherein:

a number of the plurality of parts of the upper plate is identical to a number of the plurality of lower plates.

8. The loudspeaker according to claim 6, wherein:

the upper plate is divided to the same number of parts as the parts the magnet.

9. The loudspeaker according to claim 3, wherein:

the magnet has a bar-like shape.

10. The loudspeaker according to claim 5, wherein:
the upper plate has a bar-like shape.

11. The loudspeaker according to claim 1, wherein:
the plurality of lower plates has a plurality of inner side faces facing the space, respectively,
the loudspeaker further comprising a net coupled to the inner side faces of the plurality of lower plates.

12. The loudspeaker according to claim 11, wherein:
the net is a dust-protective net.

13. The loudspeaker according to claim 11, wherein:
the net is an acoustic load adjustment net.

14. The loudspeaker according to claim 1, wherein:
the diaphragm has:
a part coupled to the voice coil; and
a protrusion section located inside of the part of the diaphragm, the protrusion protruded towards the magnetic circuit, and
the diaphragm is protruded towards the magnetic circuit, and is inserted to the space.

15. The loudspeaker according to claim 14, wherein:
the protrusion section of the diaphragm is inserted to the space only when the diaphragm is vibrated.

16. The loudspeaker according to claim 14, wherein:
the protrusion section of the diaphragm has an inverted dome-like shape in cross-section.

17. The loudspeaker according to claim 1, wherein:
the side of the upper plate opposite to the side coupled to the magnet further includes a first sub magnet that is magnetized in a direction opposite to a magnetization direction of the magnet.

18. The loudspeaker according to any one of claim 1, wherein:
the side of the plurality of lower plates opposite to the side coupled to the magnet further includes a second sub magnet magnetized in a direction opposite to a magnetization direction of the magnet.

19. The loudspeaker according to claim 18, wherein:
a side of the second sub magnet opposite to a side coupled to the plurality of lower plates further includes a shield cover.

20. The loudspeaker according to claim 1, further comprising:
a damper that is coupled to an inner circumference side of the diaphragm and one of the frame and the magnetic circuit, the inner circumference side of the diaphragm being located inside of the part of the diaphragm coupled to the voice coil.

21. The loudspeaker according to claim 1, wherein:
the plurality of lower plates are further extended to an inner side of the space to form a protector.

22. The loudspeaker according to claim 21, wherein:
the protector includes a net.

23. The loudspeaker according to claim 22, wherein:
the net is a dust-protective net.

24. The loudspeaker according to claim 22, wherein:
the net is a damping net.

25. An electronic device comprising:
the loudspeaker of claim 1.

26. The loudspeaker according to claim 25, further comprising:
an electronic circuit including an amplifying section of an electric signal inputted to the loudspeaker.

27. An apparatus comprising
the loudspeaker of claim 1.

28. The loudspeaker according to claim 27, further comprising:
a power source of the loudspeaker.

* * * * *